US006882106B2

(12) United States Patent
Kao

(10) Patent No.: US 6,882,106 B2
(45) Date of Patent: Apr. 19, 2005

(54) ELECTROLUMINESCENT DISPLAY DEVICE

(75) Inventor: Wen-Ho Kao, Taipei Hsien (TW)

(73) Assignee: Wen-Hao Kao, Taipei Hsien (TW)

( * ) Notice: Subject to any disclaimer, the term of this patent is extended or adjusted under 35 U.S.C. 154(b) by 0 days.

(21) Appl. No.: 10/777,092

(22) Filed: Feb. 13, 2004

(65) Prior Publication Data

US 2004/0160180 A1 Aug. 19, 2004

Related U.S. Application Data

(63) Continuation of application No. 10/153,678, filed on May 24, 2002, now Pat. No. 6,767,268.

(51) Int. Cl.[7] ..... H05B 33/02
(52) U.S. Cl. ..... 313/510; 313/506
(58) Field of Search ..... 313/513, 518, 313/510, 504; 368/223–227

(56) References Cited

U.S. PATENT DOCUMENTS

| | | | | |
|---|---|---|---|---|
| 3,341,916 A | * | 9/1967 | Greene | 445/24 |
| 4,853,079 A | | 8/1989 | Simopoulos et al. | |
| 6,066,830 A | | 5/2000 | Cline et al. | |
| 6,445,005 B1 | | 9/2002 | Yamazaki et al. | |

* cited by examiner

*Primary Examiner*—Joseph Williams

(57) ABSTRACT

An electroluminescent panel is provided. The electroluminescent panel comprises a front electrode layer; a luminescent layer, formed on the front electrode layer; a reflective layer, formed on the luminescent layer; a back electrode layer having at least a pattern or letters for being displayed by the electroluminiscent panel; an insulating layer, adhered onto the back electrode layer, wherein the insulating layer comprises a plurality of contact holes, and wherein the contact holes are disposed according to the pattern or letters of the back electrode layer.

10 Claims, 4 Drawing Sheets

ELECTROLUMINESCENT DISPLAY DEVICE

The application is a Continuation of my patent application Ser. No. 10/153,678, filed on May 24, 2002 now U.S. Pat. No. 6,767,268.

BACKGROUND OF THE INVENTION

1. Field of the Invention

The present invention relates to an electoluminescent panel, and more particularly to an electroluminescent panel comprising back electrode layer having letter or pattern formed thereon.

2. Description of Related Art

Electroluminescent panels are widely applied in making advertising sign boards, signal boards, ornamental panels for motor vehicles or buildings and the like because of its advantageous features of light weight and emitting light without heat. A general electroluminescent panel comprises a front electrode layer, a luminescent layer, a reflective layer, and a back electrode layer. In order to manufacture an electroluminescent panel for displaying desired letters, signs or pattern, the front electrode layer, the luminescent layer and the reflective layer are sequentially formed by performing a screen-printing process. Next, a screen plate having the desired letters, sign or pattern is used to print the desired letters, sign or pattern is placed onto the reflective layer, and then the back electrode layer is printed onto the reflective layer. When a client orders a particular design of electroluminescent panels, the manufacturer has to prepare a particular set of screen plates. Therefore, the aforementioned process would be cost effective for mass production for customers who require large quantity of electroluminescent panels for displaying same letters, signs or pattern. Therefore, it is quite expensive for manufacturing electroluminescent panel with unique or personalised letters, signs or patterns as these unique letters, signs or patterns require specific set of screen plates.

SUMMARY OF THE INVENTION

It is therefore an object of the present invention to provide an electoluminescent panel having a particular design, which can be practically and economically manufactured. According to one aspect of the present invention, the desired letters, signs or patterns are formed in the back electrode layer of an electroluminescent panel. According to another aspect of the present invention, the electroluminescent panel having a plurality of contact holes is formed in an insulating layer according to the letters, signs or patterns.

DETAILED DESCRIPTION OF THE PREFERRED EMBODIMENTS

Figure 1:
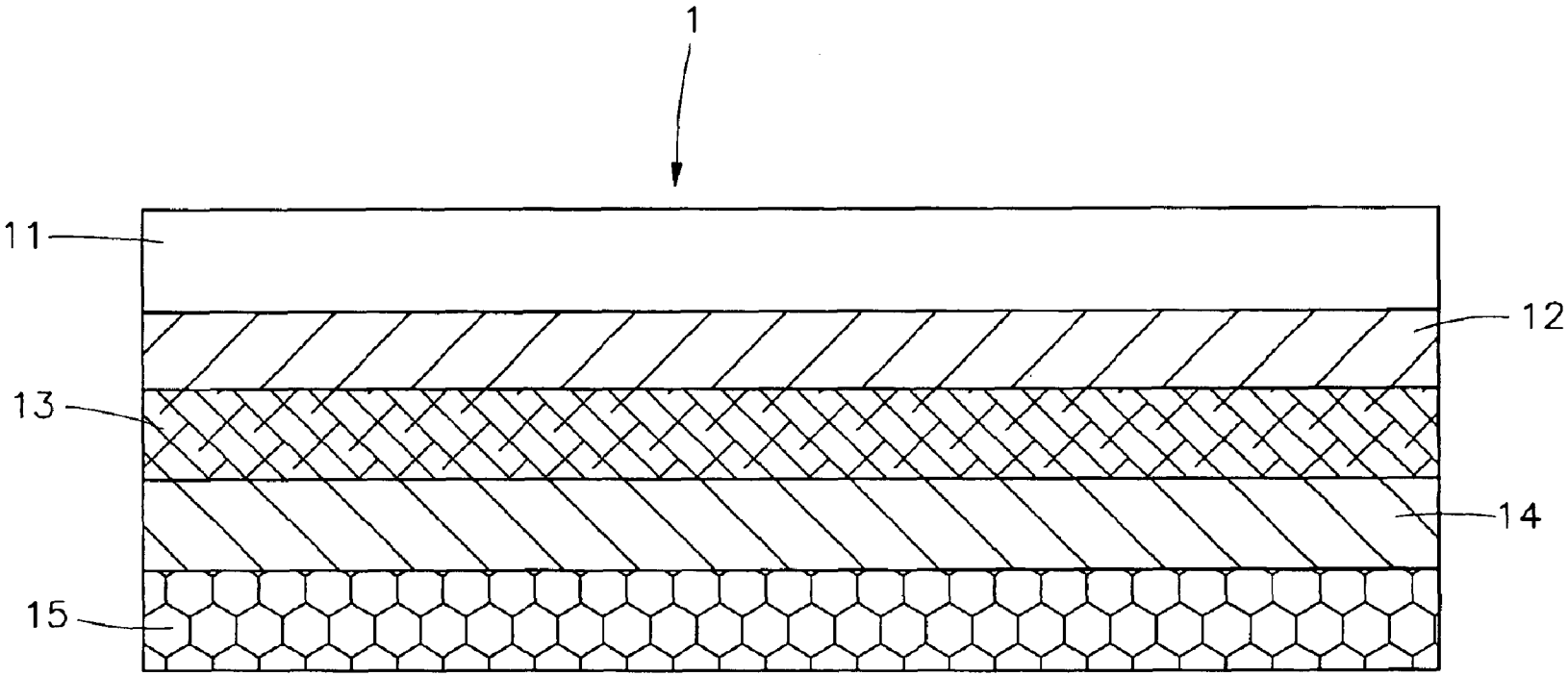
FIG. 1 is a sectional view of an electroluminescent panel constructed according to an embodiment of the present invention.
Figure 2:
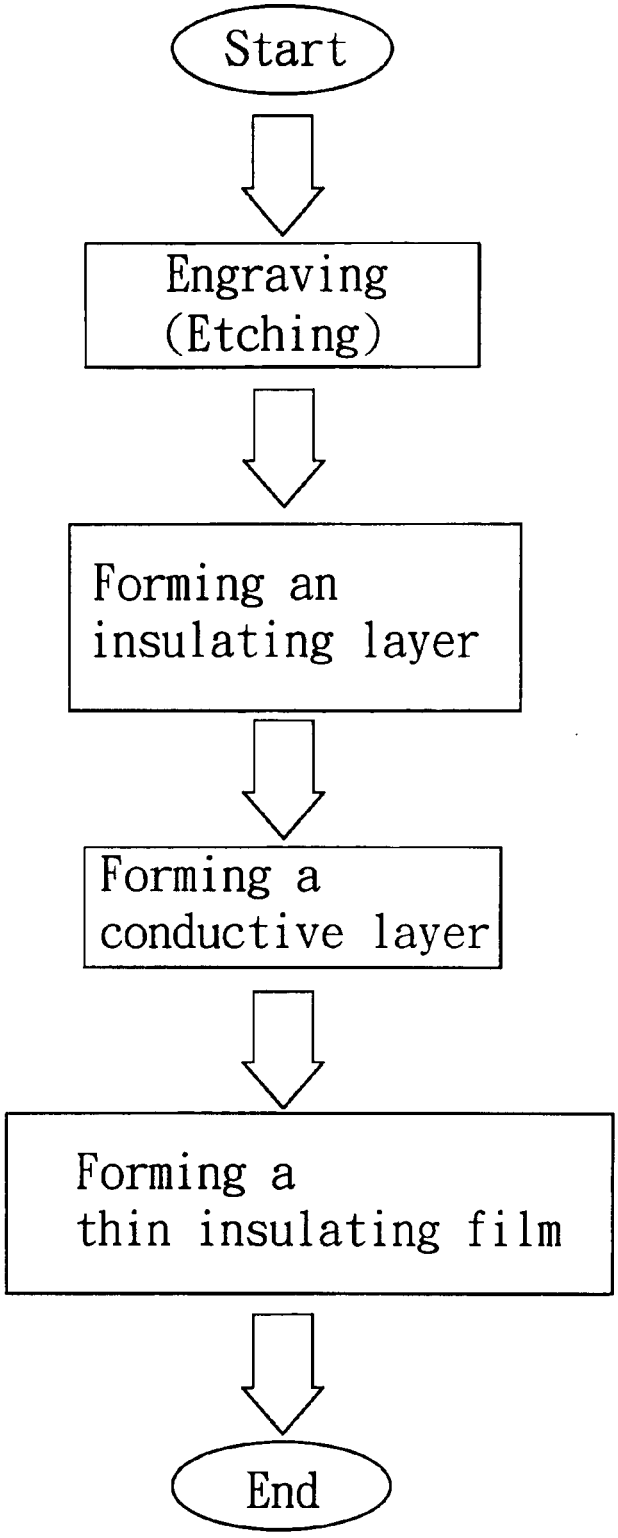
FIG. 2 is a flow chart illustrating a process of forming an electroluminescent panel according to an embodiment of the present invention.
Figure 3:
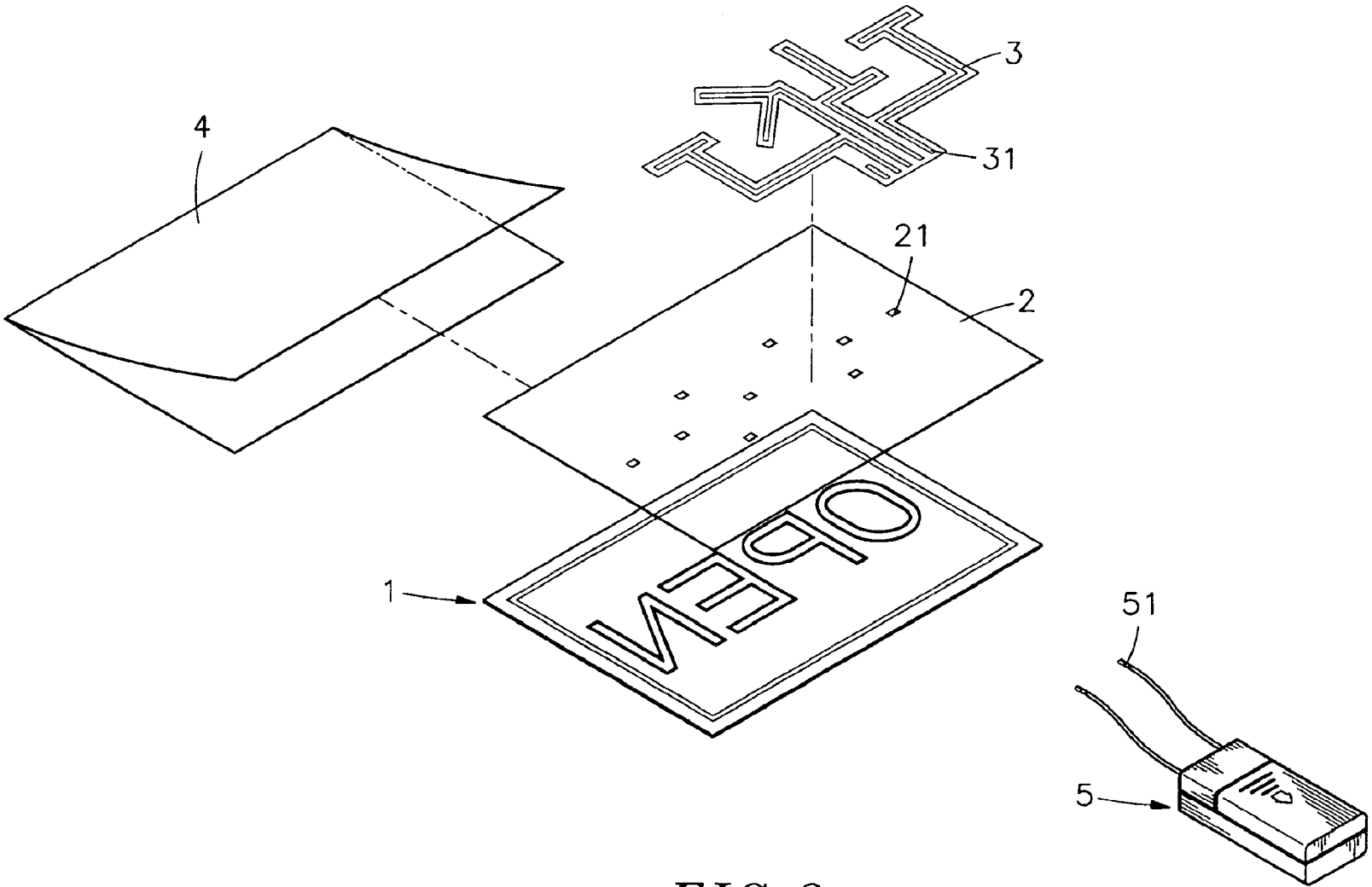
FIG. 3 is an exploded view of an electroluminescent panel according to an embodiment of the present invention.

Referring to FIGS. 1, 2, and 3, an electroluminescent panel 1 is shown comprising a transparent layer 11, a front electrode layer 12, a luminescent layer 13, a reflective layer 14, and a back electrode layer 15. The front electrode layer 12, the luminescent layer 13, the reflective layer 14, and the back electrode layer 15 are sequentially formed on the transparent layer 11 by using a printing method. Next, the back electrode layer 15 is etched to form the desired letters, signs or patterns. Thus, the manufacture of the electroluminescent panel 1 is completed.

Subsequently, an insulating layer 2 is provided. Next, a plurality of contact holes 21 is formed by engraving in the insulating layer 2. Next, insulating layer 2 is adhered on one side of the back electrode layer 15. Next, a conductive layer 3 is adhered onto insulating layer 2 such that the conductive layer 3 is connected to the contact holes 21.

The aforementioned desired letters, signs or patterns can be formed on the back electrode layer 15 by using, for example, a laser etching technique. Further, the intensity or energy of the laser beam can be controlled achieve desired etching depth to make the desired letters, signs or patterns in desired in the back electrode layer 15 and not damaging the electroluminescent panel 1.

Figure 4:
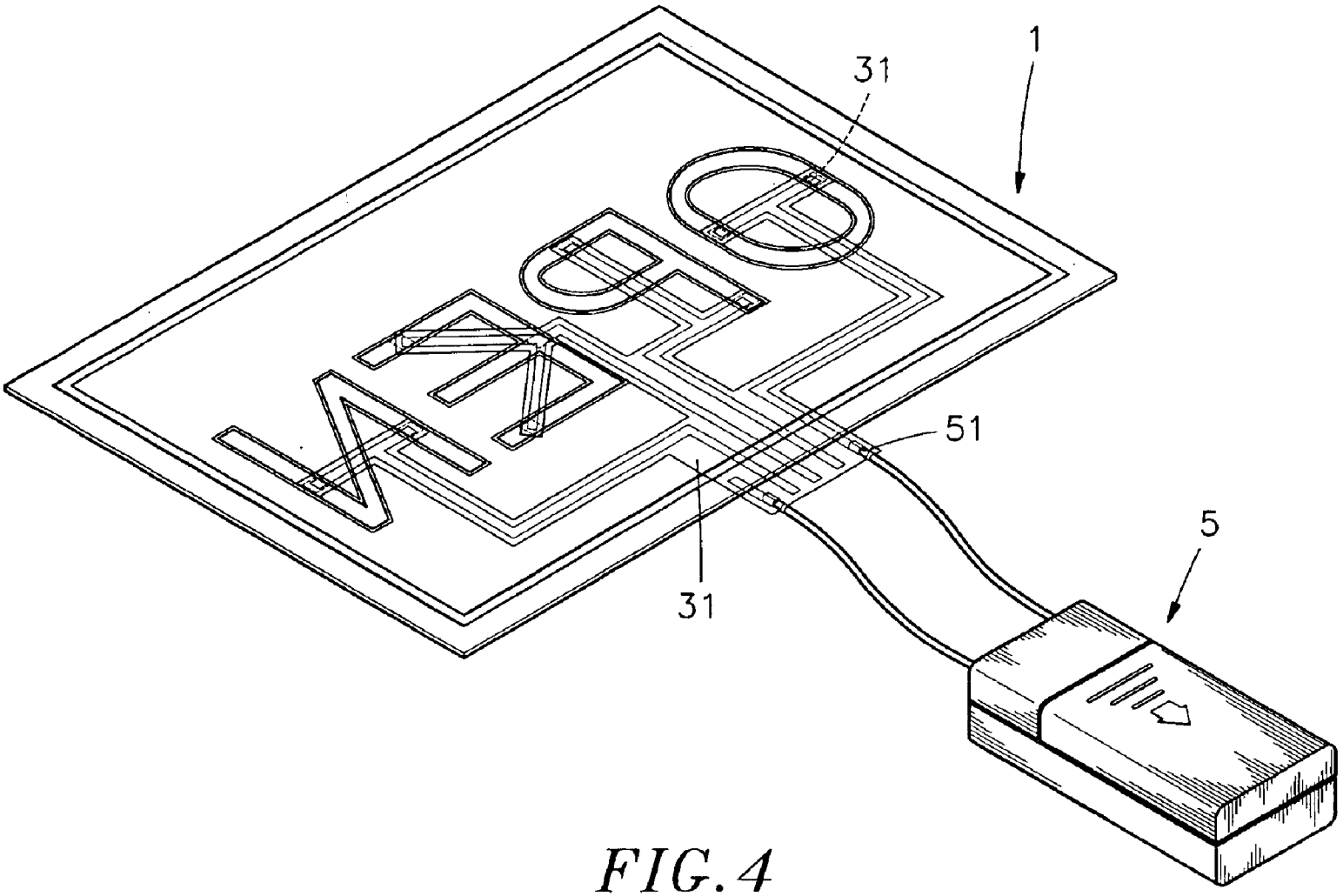
FIG. 4 is a perspective view of an electroluminescent panel according to an embodiment of the present invention.

Referring to FIGS. 3 and 4, the insulating layer 2 can be a layer of polymer film or plastic film. The contact holes 21 of the insulating layer 2 are disposed corresponding to the desired letters, signs or patterns in the back electrode layer 15 of the electroluminescent panel 1. The conductive layer 3 has lead legs 31 connected to the lead-out wires 51 of a power adapter 5. Therefore, the design of the back electrode layer 15 of the electroluminescent panel 1 is electrically connected to the power adapter 5 through the conductive layer 3 when the conductive layer 3 installed into the electroluminescent panel 1 and connected to the power adapter 5.

Alternatively, a plurality of conductive layers 3 may be adhered to the insulating layer 2 and connected to different parts of the design in the back electrode layer 15 of the electroluminescent panel 1, enabling the respective parts of the desired letters, signs or patterned in the back electrode layer 15 of the electroluminescent panel 1 to be illuminated one after another or intermittently illuminated according to a predetermined illuminating mode. Furthermore, a thin insulating film 4 may be provided for covering the conductive layer 3 and the transparent layer 11 of the electroluminescent panel 1 to protect the conductive layer 3 and the transparent layer 11. The transparent layer 11 of the electroluminescent panel 1 may comprise a desired pattern printed thereon or a thin film having a variety of patterns and colors may be adhered onto the transparent layer 11 and then different or mixed colors (not shown) are provided.

The desired letters, signs or patterns in the back electrode layer 15 of the electroluminescent panel 1 can be formed by using a laser engraving machine, an etching machine, a cutting machine, or any machine tools capable of forming the desired pattern in the back electrode layer 15 of the electroluminescent panel 1. The aforesaid conductive layers 3 can be made of a flexible circuit board, aluminum foil, copper foil, silver paste, or conductor wires. The thin insulating film 4 can be made of a transparent or semi-transparent polymer or plastic film.

Accordingly, the present invention has at least the following advantages.

Because the desired letters, signs or patterns on the back electrode layer by laser etching technique, and therefore do not require specific set of printing screen, and therefore the manufacturing the electroluminescent panel.

Because the desired letters, signs or patterns on the back electrode layer by laser etching technique, and therefore the processing time for forming the desired patterned can be effectively reduced. Therefore the overall manufacturing cost can be reduced.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electroluminescent display device, comprising:

a front electrode layer;

a luminescent layer, disposed on the front electrode layer;

a reflective layer, disposed on the luminescent layer;

a back electrode layer, disposed on the reflective layer, having at least a pattern or letters for being displayed by the electroluminiscent display device;

an insulating layer, adhered onto the back electrode, wherein the insulating layer comprises a plurality of contact holes, and wherein the contact holes are disposed according to the pattern or letters of the back electrode layer; and a patterned conductive layer, adhered onto the insulating layer, electrically connecting the contact holes, wherein the patterned conductive layer comprises a plurality of lead legs.

2. The electroluminescent display device according to claim 1, wherein the pattern or the letters is formed on the back electrode layer by using a laser etching machine, an etching machine or a cutting machine.

3. The electroluminescent display device according to claim 1, wherein the pattern or the letters is formed on the back electrode layer by performing etching, electroplating or cutting process.

4. The electroluminescent panel according to claim 1, wherein the plurality of lead legs for electrically connecting with lead-out wire of a power adapter.

5. The electroluminescent display device according to claim 4, wherein the patterned conducting layer is comprised of an aluminum foil, a copper foil or a conductive silver paste.

6. The electroluminescent display device according to claim 1, wherein the insulating layer is comprised of a polymer film or plastic film.

7. The electroluminescent display device according to claim 1, wherein the patterned conductive layer is adhered onto a surface of the insulating layer for forming a plurality of light-emitting areas within patterned conductive layer.

8. The electroluminescent display device according to claim 1, wherein an insulating film is coated onto an upper and a lower surface of the electroluniscent display device.

9. The electroluminescent display device according to claim 8, wherein the insulating film is comprised of a lamination film or plastic film.

10. The electroluminescent display device according to claim 8, wherein the insulating film is a transparent or a semitransparent film.

* * * * *

UNITED STATES PATENT AND TRADEMARK OFFICE

CERTIFICATE OF CORRECTION

PATENT NO. : 6,882,106 B2
APPLICATION NO. : 10/777092
DATED : April 19, 2005
INVENTOR(S) : Wen-Ho Kao It is certified that error appears in the above-identified patent and that said Letters Patent is hereby corrected as shown below:

On the title page (73), "Assignee: Wen-Hao Kao, Taipei Hsien (TW)" should read --Assignee: Wen-Ho Kao, Taipei Hsien--.

Signed and Sealed this

Thirty-first Day of October, 2006

JON W. DUDAS
*Director of the United States Patent and Trademark Office*